United States Patent [19]

Moulinié et al.

[11] Patent Number: 4,699,541

[45] Date of Patent: Oct. 13, 1987

[54] ROAD JOINT ELEMENT

[75] Inventors: Raoul M. Moulinié, Lachenaie; Guy Gagné, St. Sauveur des Montes, both of Canada

[73] Assignee: Z-Tech Enterprises Inc., Quebec, Canada

[21] Appl. No.: 845,529

[22] Filed: Mar. 28, 1986

Related U.S. Application Data

[63] Continuation-in-part of Ser. No. 571,372, Jan. 16, 1984, abandoned.

[30] Foreign Application Priority Data

Feb. 2, 1983 [CA] Canada ..... 1152794

[51] Int. Cl.[4] ..... E01C 11/02

[52] U.S. Cl. ..... 404/69; 404/68; 52/573

[58] Field of Search ..... 404/50-63, 404/67-69, 47; 52/396, 403, 573

[56] References Cited

U.S. PATENT DOCUMENTS

| | | | |
|---|---|---|---|
| 3,877,829 | 4/1975 | Honegger | 404/69 |
| 3,888,599 | 6/1975 | Reifsnyder | 404/69 |
| 3,904,302 | 9/1975 | Bertschmann | 52/396 X |
| 3,994,609 | 11/1976 | Puccio | 404/69 |
| 4,030,156 | 6/1977 | Raymond | 52/573 X |
| 4,120,066 | 10/1978 | Leroux | 404/69 X |
| 4,290,249 | 9/1981 | Mass | 52/396 |
| 4,290,713 | 9/1981 | Brown et al. | 404/69 |

FOREIGN PATENT DOCUMENTS

| | | | |
|---|---|---|---|
| 1028183 | 3/1978 | Canada . | |
| 1037756 | 9/1978 | Canada . | |
| 1048325 | 2/1979 | Canada . | |
| 2136842 | 2/1973 | Fed. Rep. of Germany | 404/68 |
| 2609759 | 9/1977 | Fed. Rep. of Germany | 404/69 |
| 475428 | 8/1969 | Switzerland | 404/51 |

*Primary Examiner*—Stephen J. Novosad
*Assistant Examiner*—John F. Letchford
*Attorney, Agent, or Firm*—James W. Hellwege

[57] ABSTRACT

This invention provides an improvement in a road joint assembly wherein the amount of formwork required for installation of the joint is reduced, and wherein the joint assembly is particularly useful for installations where snow plows are utilized to clear snow from roads. In accordance with the invention, the road joint assembly comprises a pair of spaced-apart rail members which have a height at least two times their width. The rail members are provided with a plurality of spaced-apart anchoring members connected to the rear wall of the rail members. The anchoring members have a top surface which extends above the rear wall of the rail members and the rail members are recessed below the road surface, so that the top surface of the anchoring members is in substantially the same plane as the road surface.

1 Claim, 3 Drawing Figures

ROAD JOINT ELEMENT

This application is a continuation-in-part of application Ser. Number 571,372, filed Jan. 16, 1984, now abandoned.

This invention relates to a road joint assembly mounted in a road structure.

The road joint assembly of this invention is particularly suitable for use in areas where snow plows are used in winter weather conditions as will be explained hereinafter.

Many configurations of road sealing elements, typically known as expansion joints, have been proposed in the past. Such expansion joints are used to join adjacent sections of road surface or pavement together. These expansion joints normally include a flexible elastomeric seal member which spans the space between the adjacent road surfaces; the seal member is held in place by suitable steel rail members which are anchored in the concrete of the road surface. The flexible sealing member permits variations in the gap between the adjacent road surfaces caused by the expansion or contraction thereof during changing climate conditions such as fluctuations in temperature. The flexible elastomeric sealing member also prevents water-seepage into the gap.

Typical of such expansion joints are those shown in U.S. Pat. Nos. 3,877,829, 3,888,599, Canadian Pat. No. 1,028,183, German No. 2,136,842 and U.S. Pat. No. 4,290,713, etc.

There are several disadvantages associated with the prior art expansion joints which have been overcome with the road joint assembly of this invention.

One such disadvantage is that suitable formwork has to be erected prior to pouring the concrete in order to provide the necessary recess for insertion of the expansion joint assembly. This leads to extra labour and additional expense in the provision and erection of suitable formwork. In addition, the erection of the formwork is usually done by suitable trades people, not usually those involved in actual installation of the road joint assembly. Thus, apart from the additional cost involved in hiring of suitable trades people for erection of formwork, there is also the fact that arrangements must be made so as to ensure that the formwork will be ready at the appropriate time.

For example, with the arrangement of German No. 2,136,842 (Sohne), metal sheets are provided below the rail members in the gap so that when concrete is poured, none will enter the gap. In addition, this German reference includes a support for its anchoring plate, mounted below the plates, and as such, the arrangement of components in Sohne requires somewhat complicated and specific formwork in order to prevent concrete from entering the gap.

Likewise, with the arrangement shown in U.S. Pat. No. 4,290,713 (Brown et al), one must also utilize a fair amount of formwork to prevent any concrete from entering the gap. In view of the arrangement of Brown et al's anchoring plates, it is not possible, e.g., to first pour a lower deck, and then position the rail members on the lower deck to complete the pouring of concrete, and wherein the rail members themselves would constitute the formwork for completion of the pouring.

Further, when such prior art expansion joints are installed in road or bridge surfaces over which snow plows frequently travel in winter weather, the road joint assembly is often subjected to impact force such as from the blade of a snow plow. Thus, wear of the adjacent roadway surfaces, such as is caused from the continuous passage of traffic along the roadway, is an expected occurrence; although when the steel rails of the expansion joint assembly are installed they are usually flush with the road surface, the subsequent wear on the road surfaces results in the steel rails of the expansion joint sometimes extending slightly above the level of the road surface since the surrounding pavement has been worn down to a certain extent. Although the assembly may only be above the level of the road surface by a very small degree not readily noticeable to regular traffic on the road, the blade of a snow plow, in use, will forcibly strike the rail members of the expansion joint causing a jolt or shock to part or all of the assembly of the expansion joint. As will be appreciated, such stress will detrimentally affect the expansion joint and will naturally deleteriously limit the effectiveness of the joint over a period of time, as well as shorten the life thereof so that more frequent replacement of the joint is necessary.

German No. 2,136,842 has attempted to overcome the problem of wear of a road surface by providing anchoring plates attached to the rail members and which have upper surfaces in flush alignment with both the road surface and the top of the rail members. Thus, these plates have a bevelled edge facing away from the joint with a rounded upper edge so that in the event of heavy wear on the road, the leading edges of the anchoring plates cannot project above the surface of the traffic path or road.

However, with such an arrangement in which the rail members are also mounted in flush alignment with the road surface, when, e.g., a snow plow is travelling on the road surface, the blade of the snow plow would tend to hit not only the plates but also the upper surface of the rail members themselves, thus causing wear on the joint assembly, and reducing the life span thereof, not only from the point of view of stress on the rail members per se, but also in view of the fact that the rail members of Sohne are not supported on a lower deck of concrete. That is, the rail members of Sohne are seated in the gap per se, and are not supported by any concrete deck.

The arrangement shown in Brown et al does not contemplate the provision of anchoring plates which would serve in any way to aid in deflecting a snow plow blade and thus, the arrangement illustrated by Brown et al would also be subject to wear and a shortened life span when used in areas where snow plows are utilized.

Another disadvantage with the prior art expansion joint assemblies is that when it does become necessary to repair or replace a joint assembly, a major portion of the concrete deck must be destroyed. Thus, with the Sohne arrangement, the concrete deck must be destroyed not only up to the depth of the rail member but also, up to the depth of the plate and in addition, the additional supporting member provided below the plates. With the Brown et al device, it would be necessary to destroy an even greater portion of the concrete deck to replace the joint assembly. Again, in replacing the joint assembly, more formwork is then required to set the joint in concrete.

With this invention, the above disadvantages have been overcome with the provision of an expansion joint assembly of a simple construction which does not require the use of a major amount of formwork in order to prevent concrete from entering the gap. The joint of this invention is also of such construction that any stress or impact force such as from the blade of a snow plow is deflected and will not shorten the life or efficacy of the joint.

In accordance with an embodiment of the present invention, there is provided an improvement in a road structure having a road joint assembly mounted in the road, with a transversely extending rail member placed in close spaced-apart opposed relationship to a similar or identical rail member with a sealing member adapted to extend between the two and with a plurality of spaced-apart anchoring members connected to the rail members and adapted to anchor the rail members in concrete or a like material. The improvement comprises a rail member capable of reducing the amount of formwork normally required for a joint assembly, the rail member having an elongated hollow body having a height at least two times the width thereof with the body having a rear wall comprising a load bearing wall; the rear wall of the rail member and a rear edge of the anchoring members being integrally joined together in a different horizontal plane and with the rear edge of the anchoring member being above the rear wall of the rail member, the rail member and the anchoring members being joined together in an angular relationship relative to each other; the anchoring members being of rigid material having a top surface and being located at substantially the same plane as the road surface to receive a load bearing force from a snow plow blade or the like, the top surface having a tapered or rounded leading edge; the rail member having a recessed upper traffic-bearing wall member extending from the rear wall which is spaced below the road surface and the top surface of the anchoring member, and a spaced apart lower wall member extending from the rear wall; a first front wall member extending downwardly from the upper wall member and a second front wall member extending upwardly from the lower wall member and being spaced from the first front wall member to form a seal engaging means in the form of a longitudinal gap in the upper part of the hollow rail member, the longitudinal gap being in communication with the hollow body; the rear wall extending from the top to the bottom of the rail member and having a height substantially equal to the depth of an opening in which the rail member and anchoring member are adapted to be mounted, the rear wall of the rail constituting a forming wall against which a concrete-forming or like material is adapted to be placed, the lower wall forming a bearing surface which is adapted to be supported and mounted against a substrate surface, the spaced apart anchoring members having a gap between adjacent anchoring members.

The rail members used in the road joint assembly of this invention are of an integral construction with the anchoring members which is pre-assembled at the manufacturer. This allows for easier installation and less expense in the provision of additional material such as anchor bolts, formwork for the concrete, additional labour, etc. The rail member is of a rigid metal material such as steel and may be brake- or roll-formed into the desired configuration.

The dimensions of the rail member are constituted by a height which is usually at least two, and preferably three or more times, its width from the rear wall to the front wall. The thickness of the material from which the rail member is made may range from $\frac{1}{8}$ inch to $\frac{1}{2}$ inch or more depending on its intended use.

The anchoring member of this invention is of a generally flat plate-like configuration of a rigid material having an overall rectangular shape, and is fixedly secured to the rear wall of the rail member. The securement of the anchoring member to the rail may be attained by means of welding or any other suitable means such as bolts, etc. The anchoring member is preferably of a planar sheet metal material and is relatively thin in thickness relative to the material of the rail member.

One edge of the top surface of the anchoring member is provided with a tapered or rounded outline; if tapered, the edge typically may be at an angle of 45° or less; if rounded, it should preferably be very smooth and have a fairly large arc of curvature to it.

The anchoring member may also include a number of apertures therein to aid in its anchorage and alignment in concrete as will be explained hereinafter; such apertures may be of various shapes and sizes.

The anchoring member is constituted by a height which is substantially equal to, or slightly more or less, than the height of the rear wall of the rail member. The only criticality in this respect is that the top surface of the anchoring member, when affixed to the rail, is above the plane of the top wall of the rail. Preferably, the top surface of the anchoring member extends above the plane of the top wall of the rail as much as $\frac{1}{4}$ inch. Typically, the anchoring member is positioned so that the top surface extends about 3/16 inch above the plane of the top wall of the rail.

As will be appreciated, the longitudinal length of the rail member will be determined by the width of the road surfaces to be joined together. The length of the rail member, as well as the load bearing strength desired, in turn will determine the number and placement of the anchoring members along the length of the rail. Typically, such anchoring members may be arranged at intervals of 18 inches, preferably 12 inches, along the length of the rail member.

The seal used in the road joint assembly of this invention may have any suitable configuration to span the space between adjacent road surfaces. As is known in the art, the seal must be of a size and configuration to allow for movement of the road surfaces toward and away from each other due to expansion and contraction thereof, while providing a substantially waterproof seal between adjacent road sections. Representative of the amount of movement provided for by such seals is around 3 inches. The seal contemplated for use in the joint assembly of this invention is of an elastomeric rubber material such as Neoprene.

Having thus generally described the invention, reference will now be made to the accompanying drawings, illustrating preferred embodiments, and in which.

Figure 1:
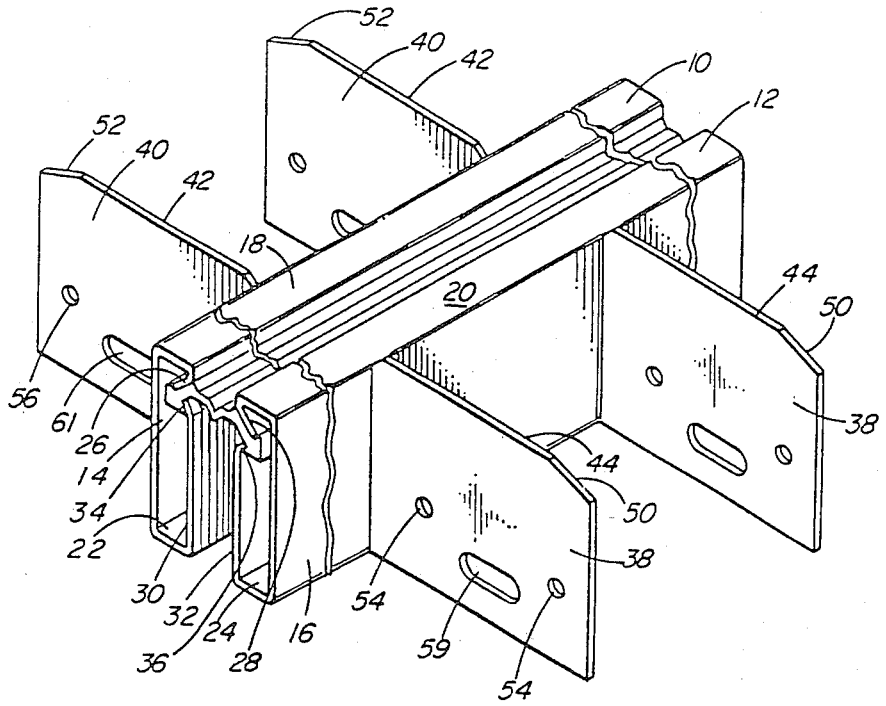
FIG. 1 is an elevational view of the road joint assembly of this invention in an assembled condition.

Referring now to the drawings in greater detail, FIG. 1 illustrates the road joint assembly in an assembled condition. The road joint assembly comprises rail members 10 and 12 having rear, load-bearing walls 14 and 16, upper walls 18 and 20 and bottom walls 22 and 24. Each rail member 10 and 12 further comprises front upper walls 26, 28 and front lower walls 30, 32, respectively. Front walls 26, 28 are spaced from front walls 30, 32 to form a longitudinal gap between the outer edges of front walls 26 and 30 as well as between front walls 28, 32 along the length of the rail members 10 and 12. In the embodiment illustrated in FIG. 1, upper front walls 26, 28 extend downwardly from top walls 18 and 20 and angle inwardly towards rear walls 14 and 16, while lower front walls 30, 32 extend upwardly from bottom walls 22 and 24. Lower front walls 30 and 32 extend in a substantially straight manner with a slight inward deviation 34, 36, respectively, at the upper portion thereof.

As will be seen from FIG. 1, the walls 14, 18, 22, 26 and 30 provide rail member 10 (as well as rail 12 and its associated walls) with a substantially elongated outline having a height larger than the width thereof. The height of the rail member is at least twice and preferably three or more times the width thereof.

Anchoring members 38, as shown in FIG. 1, comprise a flat plate-like member of rigid material abutting rail member 12, in the illustrated embodiment at right angles thereto, relative to the rear wall 16. Similarly, anchoring members 40 abut rear wall 14 of rail member 10 at right angles.

Figure 2:
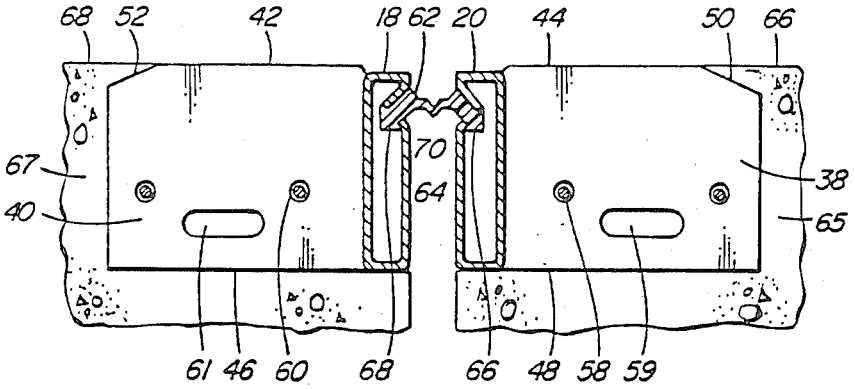
FIG. 2 is a section taken along the line 2—2 of FIG. 3.

As shown in FIG. 2, the rear edge of the anchoring member 38 is joined to the rear wall 14 of rail member 10 so that the top surface 42 of anchoring member 40 is in a different horizontal plane from the upper wall 18 of rail member 10. As will also be seen from FIG. 2, upper wall 18 of the rail member is recessed relative to the road surface, while top surface 42 of anchoring member 40 is in the same plane as the road surface 68. Thus, anchoring members 38 and 40 are positioned so that top surfaces 42, 44 extend slightly above the plane of upper walls 18 and 20 of the rail members, while being in substantially flush alignment with the road surfaces 66, 68. The bottom surfaces 46, 48 of the anchoring members may either be in the same plane as the bottom walls of the rail members or may be above or below the plane of the bottom walls of the rail member. The only criterion with respect to the positioning of the anchoring member on the rail member is that the top surface of the anchoring member should be above the plane of the top wall of the rail. As will be explained hereinafter, the anchoring member will deflect impact forces so that the joint assembly is not affected by such stresses. By also providing the anchoring member with a height approximating that of the rail member, better and more even anchorage in concrete is obtained.

As will be noted from FIG. 2, the combination of the rails with the anchoring members provide the necessary "formwork" for pouring of the concrete decks 65, 67 surrounding the assembly. If, as shown in FIG. 2, it is desired to have the decks 65, 67 extend below the plane of the bottom surfaces 46, 48 of the anchoring members, suitable formwork can be erected prior to pouring of the concrete; however, as will be appreciated, the amount of formwork required will be substantially less and will involve less labour than fore conventional expansion joints since the assembly of this invention creates its own "formwork" and the only additional formwork required, if desired, would be for extending the deck below the plane of the lower surfaces of the assembly; as mentioned, however, any formwork required for this purpose is of minor consideration due to the major formwork already being constituted by the device of this invention. Thus, once the lower deck portion has been poured, the rail and anchoring members are seated in position on the lower deck, thereby constituting formwork for the upper deck portion which may then be poured.

Top surface 44 of anchoring member 38 is provided, at its leading end, with a tapered or angled edge 50. In a like manner, top surface 42 of anchoring member 40 is provided with tapered edge 52. If desired, however, the leading edge of the anchoring member could be provided with a rounded edge. The deviation in the top surface of the anchoring member acts as a deflection surface for the blade of a snow plow or other device which could cause damage to the joint assembly.

One or more apertures 54, 56 may be provided in the anchoring plates, through which longitudinally extending rods 58, 60 (FIG. 2) may be passed. Rods 58, 60 serve to align and further anchor the whole assembly in concrete. Further apertures 59 and 61 may also be provided in the anchoring members to further aid in the anchorage of the assembly when the concrete is poured.

Seal member 62 spans the space 64 between adjacent road sections 66, 68. As will be seen, seal member 62 has outer opposed edges 66, 68 which nest in the gaps formed between the upper and lower front walls of each rail member 10 and 12. Seal member 62 is constituted by an elastomeric strip having a central V-shaped portion 70 having outer end members 66 and 68, having an arrow-shaped configuration in the illustrated embodiment, adapted to nest in the longitudinal gaps formed between the upper and lower front walls of each rail member.

Figure 3:
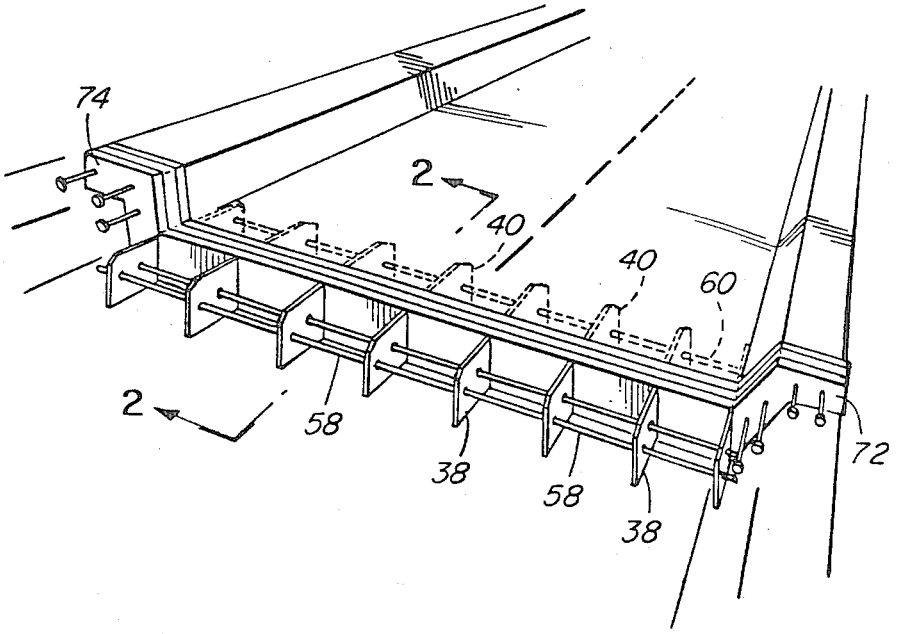
FIG. 3 is a perspective view of the road joint assembly installed in a road surface.

FIG. 3 illustrates a typical installation of the joint assembly of this invention spanning the width of a road surface. As will be noted, the rails 10 and 12 are of a longitudinal length substantially equal to that of the road surfaces to be joined together. Anchoring members 38 and 40 are positioned at spaced intervals along the longitudinal length of the rail members and have longitudinally extending rods 58 and 60 extending through apertures in the anchoring members. When installed in a road surface, the rail members are typically provided with right-angled end support members 72 and 74 at the opposite edges of the road surface. Such support members may be bolted or otherwise suitably affixed to the rail members. It will be appreciated that alternative arrangements of end support members may be used in conjunction with the road joint assembly of this invention. Such arrangements will be evident to those skilled in the art and will not be discussed herein.

When the road joint assembly is installed to join adjacent road surfaces together, the top surface of the anchoring member is positioned in substantially flush alignment with the road surface (see FIG. 2). If wear of the roadway surfaces occurs so that the assembly extends slightly above the level of the road surface, it will be noted that the anchoring members will deflect the impact of any force exerted on the assembly by a snow plow blade or the like. Thus, upon passage of a snow plow over the road surface travelling from right to left or left to right in FIG. 2, the blade of the snow plow will initially strike the tapered edge of the anchoring member causing an uplifting of the snow plow blade which thus will avoid the direct impact of the snow plow blade on the rail member, particularly in view of the fat that the rail member is slightly recessed or spaced below the road surface. The impact force of the snow plow blade will be borne by the anchoring member and associated rods and accordingly, damage to the rails and seal is virtually precluded.

It will be appreciated that although in the embodiment illustrated, the anchoring members 38 and 40 abut the rear walls 14 and 16 at approximately 90° thereto, variations in the placement of the anchoring members relative to the rear walls are possible. Thus, for example, in situations where it is necessary to place a road joint assembly diagonally across a road or bridge surface, the anchoring members should be positioned so that the leading tapered edge is in the direction of the passage of traffic along the road or bridge so that a snow plow travelling over the joint will strike the leading tapered edge. As such, when the rails are placed diagonally across a road or bridge with the leading edge of the anchoring members facing the direction of oncoming traffic, the rear walls 14 and 16 would form an angle of less than 90° relative to the anchoring members 38 and 40.

In addition to the advantages obtained with the use of the joint of this invention relative to avoiding damage to the rail and seal, the device of this invention also provides anchoring means for the rails as an integral part of the rail. Thus, there is no need to provide additional, separate anchor bars to aid in anchorage of the assembly in concrete.

Further, there is no need for the erection of separate formwork in order to pour the concrete in installation of the assembly since the assembly itself provides such means.

It will also be appreciated that when it is desired to replace a joint assembly installed in a road surface, with the assembly of the present invention, this becomes a much easier task. Thus, it would only be necessary to destroy the upper deck portion with the assembly of this invention; that is, only that portion of the deck to the depth of the rail member need be destroyed so that the joint assembly can be removed. A new assembly may then simply be positioned on the remaining lower deck, and a new upper deck poured.

We claim:

1. In a road joint assembly for mounting in a road between two adjacent spaced apart sections of the road, said assembly including two spaced apart mirror-image components securable at opposing edges of said spaced apart sections and a seal means extending between opposed faces of said components and securing said two components to one another, the improvement wherein each said component comprises:

an elongated hollow rectangular rail having an upper wall, a lower wall, a front wall and a rear wall;

said front wall being provided along its upper extent with a gap extending along the longitudinal axis of said rail, said gap being defined by a space between an uppermost downwardly and inwardly extending flange and a lowermost upwardly and inwardly extending flange;

said rear wall constituting a forming wall against which the material of which said road is comprised is adapted to be placed, and including a plurality of monolithic anchoring plates spaced from one another along the longitudinal axis of the rail and extending from said rear wall in an angular relationship thereto, said anchoring plates, at the juncture with said rail at said rear wall, being defined by a downwardly tapered edge, the lower end of which tapered edge is joined to said upper wall of said rail, said lower wall being coextensive with the lower edge of said anchoring member and forming a bearing surface which is adapted to be supported and mounted against a substrate surface; and the height of said rail being at least three times the width of said rail.

* * * * *